US007623812B2

(12) United States Patent
Kagawa

(10) Patent No.: US 7,623,812 B2
(45) Date of Patent: Nov. 24, 2009

(54) IMAGE FORMING APPARATUS, CHARGING ROLLER, PRODUCTION METHOD OF CHARGING ROLLER, PRODUCTION APPARATUS OF CHARGING ROLLER

(75) Inventor: Toshiaki Kagawa, Kitakatsuragi-gun (JP)

(73) Assignee: Sharp Kabushiki Kaisha, Osaka (JP)

( * ) Notice: Subject to any disclaimer, the term of this patent is extended or adjusted under 35 U.S.C. 154(b) by 242 days.

(21) Appl. No.: 11/785,974

(22) Filed: Apr. 23, 2007

(65) Prior Publication Data

US 2007/0253739 A1 Nov. 1, 2007

(30) Foreign Application Priority Data

Apr. 28, 2006 (JP) ..... 2006-127059

(51) Int. Cl.
*G03G 15/02* (2006.01)

(52) U.S. Cl. ..... 399/176

(58) Field of Classification Search ..... 399/174, 399/176; 361/225; 492/28; 29/895
See application file for complete search history.

(56) References Cited

U.S. PATENT DOCUMENTS 4,724,508 A * 2/1988 Macy ..... 361/225
5,418,605 A 5/1995 Arahira et al.
6,317,574 B1 * 11/2001 Shinohara et al. ..... 399/176
6,706,459 B2 * 3/2004 Kojima et al. ..... 399/174 X
6,909,859 B2 * 6/2005 Nakamura et al. ..... 399/175 X
2002/0031377 A1 3/2002 Inoue et al.
2002/0035020 A1 3/2002 Yamaguchi et al.
2004/0224245 A1 * 11/2004 Shigezaki et al. ..... 430/66

FOREIGN PATENT DOCUMENTS

JP 6-175466 6/1994
JP 11-109721 4/1999
JP 2002-040759 * 2/2002
JP 2002-40759 A 2/2002
JP 2002-082528 A 3/2002
JP 2006-029390 2/2006
JP 2006-113115 4/2006

* cited by examiner

*Primary Examiner*—Sandra L Brase
(74) *Attorney, Agent, or Firm*—Nixon & Vanderhye, PC

(57) ABSTRACT

A contact angle of water on the surface of a charging roller is equal to or smaller than a contact angle of water on the surface of the photo conductor.

This structure prevents slip of the charging roller in an image forming apparatus wherein the charging roller is rotated due to the driving force of the photo conductor which is transmitted from the photo conductor as the charging roller comes in contact with the surface of the photo conductor.

20 Claims, 9 Drawing Sheets

10Y,10M,10C,10B 10Y,10M,10C,10B

IMAGE FORMING APPARATUS, CHARGING ROLLER, PRODUCTION METHOD OF CHARGING ROLLER, PRODUCTION APPARATUS OF CHARGING ROLLER

This Nonprovisional application claims priority under 35 U.S.C. § 119(a) on Patent Application No. 2006/127059 filed in Japan on Apr. 28, 2006, the entire contents of which are hereby incorporated by reference.

FIELD OF THE TECHNOLOGY

The present technology relates to an image forming apparatus of an electrophotography mode, and a charging roller provided in an image forming apparatus of an electrophotography mode, production method of charging roller, and production apparatus of charging roller.

BACKGROUND OF THE TECHNOLOGY

Many image forming apparatuses such as photocopiers or laser printers adopt an electrophotography mode in which the surface of a photo conductor serving as an image carrier is charged by a charging device, and then is exposed by an exposure device. The resulting electrostatic latent image on the photoconductor is thereafter developed by a development device to be a toner image. Further, the toner image is electrostatically transferred to a transfer medium such as a recording paper by a transfer device, and the toner image transferred to the recording paper is finally fixed to the paper by a fixing device. An image is thus formed on a recording paper.

A general charging device is broken into a noncontact charging mode and a contact charging mode. The noncontact charging mode generally uses so-called a corotron charging device or a scorotron charging device. These charging devices generate corona discharge, and supplies electric charges to the photo conductor through the air. In such a noncontact charging mode, the charging device does not come in contact with the photo conductor, and therefore it causes less contamination or ablation of the photo conductor, which is a certain advantage. On the other hand, the corona discharge generates by-products such as ozone, which is not desirable.

In recent years, with the increased ecology consideration, a charging device of a contact charging mode not using corona discharge is attracting attention. A charging device of a contact charging mode includes a rubber roller member, which is charged by a predetermined voltage and is brought into contact with a photo conductor. The roller containing a rubber member is generally called a charging roller.

However, in the charging device of a contact charging mode, the photo conductor and the charging member are directly in contact with each other, and residue toner on the photo conductor or contaminant such as paper dust is adhered to the charging member, which causes inadequate charging.

In view of this problem, Patent Document 1 (Japanese Unexamined Patent Publication Tokukaihei 6-175466 (published on Jun. 24, 1994), corresponding US patent: U.S. Pat. No. 5,418,605) teaches a technology of preventing adhesion of contaminant to the surface of the charging roller by increasing a contact angle of water (increasing the hydrophobic property) on the surface of the charging roller (conductive roll) to be greater than the contact angle of water on the surface of the photo conductor. The contact angle of water designates an angle created by the surface of a water droplet and the surface of a solid at a contact point therebetween when the solid and a free surface (interface with the gas phase) of the water droplet are in contact in an equilibrium state. This angle is illustrated in FIG. 10.

However, in the technique of Patent Document 1, an increase in contact angle of water on the surface of the charging roller weakens the grip force between the charging roller and the photo conductor.

Therefore, in a structure where the charging roller is rotated due to the driving force of the photo conductor which is transmitted from the photo conductor as the charging roller comes in contact with the surface of the photo conductor, charging roller slips, causing an image defect which appears as black stripes.

The slip of charging roller more frequently occurs in a high-speed process, or in a structure using a photo conductor coated with a lubricant agent. Further, in the case where only a direct current is applied to the charging roller, the image defect of black stripes due to the slip of charging roller appears more significantly.

SUMMARY OF THE TECHNOLOGY

The present technology is made in view of the foregoing conventional problem, and an object is to prevent image defect due to slip of a charging roller in an image forming apparatus in which the charging roller is rotated due to the driving force of the image carrier which is transmitted from the image carrier as the charging roller comes in contact with the surface of the image carrier.

In order to solve the foregoing problem, an image forming apparatus comprises an image carrier for carrying an electrostatic latent image; and a charging roller which rotates in contact with a surface of the image carrier by transmission of a rotation force of the image carrier, wherein: a contact angle of water on a surface of the charging roller is equal to or smaller than a contact angle of water on the surface of the image carrier.

With this arrangement, a contact angle of water on a surface of the charging roller is equal to or smaller than a contact angle of water on the surface of the image carrier. On this account, the grip force between the charging roller and the image carrier increases, and the slip of charging roller is prevented.

A charging roller is a charging roller for charging an image carrier by coming in contact with a surface of the image carrier, wherein a surface of the charging roller is processed by corona discharge treatment.

With this structure, the corona discharge treatment processes the charging roller to have a smaller surface contact angle of water. On this account, the grip force between the image carrier and the charging roller increases, which prevents the slip of the charging roller.

A production method of charging roller is a method for charging an image carrier by coming in contact with a surface of the image carrier. The method comprises the step of: (a) processing a surface of the charging roller by corona discharge treatment.

With this method, the corona discharge treatment processes the charging roller to have a smaller surface contact angle of water. With this effect, the foregoing method makes it possible to produce a charging roller with a greater grip force between the image carrier and the charging roller with which the slip of the charging roller is securely prevented.

A production apparatus of a charging roller is a production apparatus of a charging roller which charges an image carrier by coming in contact with a surface of the image carrier, the production apparatus comprising a retention section for retaining a charging roller; and a discharge section for generating corona discharge to the charging roller retained by the retention section.

With this structure, corona discharge is generated between the charging roller and the discharge section, so as to process the charging roller by a corona discharge treatment. The contact angle of water on the surface of the charging roller thus decreases. This makes it possible to produce a charging roller with a greater grip force between the image carrier and the charging roller with which the slip of the charging roller is securely prevented.

Additional objects, features, and strengths of the technology will be made clear by the description below. Further, the advantages of the technology will be evident from the following explanation in reference to the drawings.

BRIEF DESCRIPTION OF THE DRAWINGS

FIG. 9(*b*) is a magnified view of a part of the charging roller production apparatus of FIG. 9(*a*).

DESCRIPTION OF THE EMBODIMENTS

First Embodiment

The following explains one embodiment.

Figure 2:
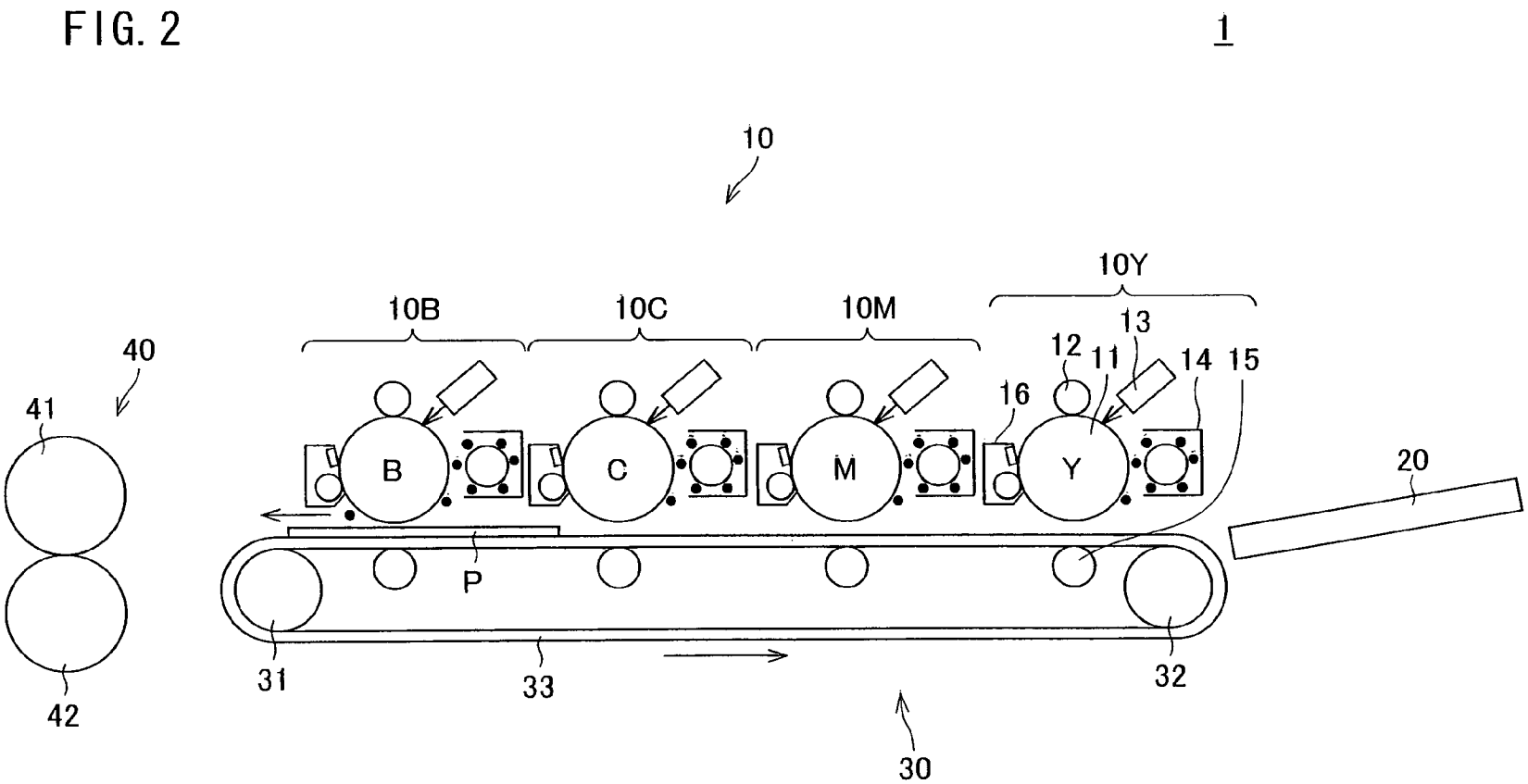
FIG. 2 is an explanatory view illustrating a structure of an image forming apparatus according to one embodiment.

FIG. 2 is an explanatory view illustrating a schematic structure of an image forming apparatus 1 according to the present embodiment. An image forming apparatus 1 is a color image forming apparatus of an electrophotography mode. The image forming apparatus 1 forms a multicolor or monochrome image on a recording paper based on image data, such as image data transmitted from an external device via a network or image data scanned by an image scanning apparatus (not shown).

As shown in FIG. 2, an image forming apparatus 1 includes a visible image forming unit 10, recording paper carrying means 30, a fixing device 40, and a supply tray 20.

A visible image forming unit 10 is broken into four visible image forming units 10Y, 10M, 10C and 10B, respectively corresponding to yellow (Y), magenta (M), cyan (C), and black (B). More specifically, the visible image forming unit 10 is constituted of four visible image forming units 10Y, 10M, 10C and 10B wherein the visible image forming unit 10Y carries out image forming using toner of yellow (Y), the visible image forming unit 10M carries out image forming using toner of magenta (M), the visible image forming unit 10C carries out image forming using toner of cyan (C), and the visible image forming unit 10B carries out image forming using toner of black (B). To specifically describe the layout, the four visible image forming units 10Y, 10M, 10C and 10B are adjacently provided in this order from the side of the supply tray 20 to the side of the fixing device 40 along the carriage path of recording paper, so that toner images of respective colors are sequentially layered on a recording paper carried.

Figure 1:
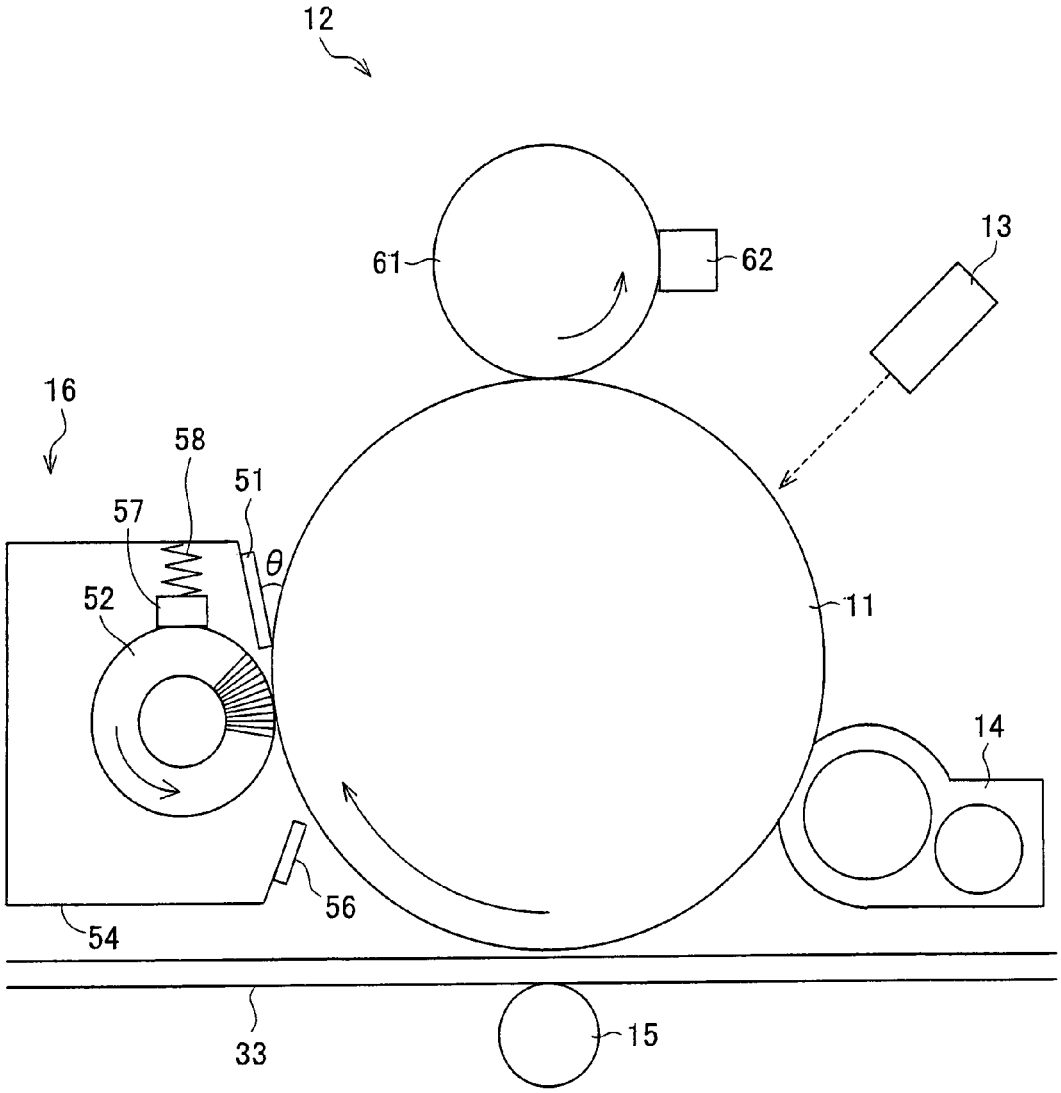
FIG. 1 is a cross-sectional view illustrating a structure of a visible image forming unit in an image forming apparatus according to one embodiment.

FIG. 1 is a cross-sectional view illustrating structures of the visible image forming units 10Y,10M,10C and 10B.

As shown herein, the visible image forming units 10Y, 10M, 10C and 10B are substantially the same in structure. More specifically, each visible image forming unit includes a photo conductor (photo conductor drum, image carrier) 11, a charging device 12, a laser light irradiating means 13, a development device 14, a transfer roller 15, and a cleaner unit 16.

The photo conductor 11 has a drum shape, and is supported by a casing (not shown) to be rotatable about the casing. The photo conductor 11 is made of a support base of an aluminum alloy or the like whose surface is coated with a photosensitive layer. The photo conductor 11 may be realized by any conventionally-known photo conductor. However, as described later, the photo conductor 11 of the present embodiment is set so that a contact angle of water on its surface is equal to or greater than the contact angle of water on the surface of the charging roller 61 in the charging device 12.

More specifically, in this embodiment, the contact angle of water on the surface of the photo conductor 11 is 100°, and the contact angle of water of the charging roller 61 is equal to or lower than 100°. Note that, instead of the drum-shaped photo conductor above, the photo conductor 11 may be formed of a photo conductor belt. In the present embodiment, process speed, i.e. the rotation speed (movement speed of the surface of the photo conductor 11) is set to 355 mm/s.

The charging device 12 serves to evenly charge the surface of the photo conductor 11 to a predetermined potential. The present embodiment uses a charging device which charges the photo conductor 11 by bringing its charging roller into contact with the surface of the photo conductor 11.

The charging device 12 is described later in detail.

The laser light irradiating means 13 serves to expose the surface of the photo conductor 11 charged by the charging device 12 according to image data, so as to form an electrostatic latent image on the surface of the photo conductor 11. The development device 14 develops the electrostatic latent image formed on the surface of the photo conductor 11 by toner to form a toner image. The transfer roller 15 is supplied with a bias voltage opposite in polarity to the bias voltage applied to toner, and transfers a toner image from the photo conductor 11 to a recording paper carried by the recording paper carrying means 30.

The cleaner unit 16 cleans the surface of the photo conductor 11 by removing/collecting residue toner from the surface of the photo conductor 11 after the transfer process by the transfer roller 15 is completed. As shown in FIG. 1, the cleaner unit 16 includes a blade (cleaning blade) 51, a brush roller (application section) 52, a lubricant agent 57, and a biasing member 58 inside or in the surrounding area of the casing 54.

The blade 51 serves to collect residue toner from the surface of the photo conductor 11. The blade 51 is formed of a lengthy rubber member whose longitudinal side extends along the axis direction of the photo conductor 11.

This blade 51 is mounted to a downstream portion of an opening of the photo conductor 11 in terms of the circumference direction. One longitudinal side of the opening is provided on the casing 54, and the other longitudinal side has an edge in contact with the surface of the photo conductor 11.

The lubricant agent (solid lubricant agent) 57 is applied to the surface of the photo conductor 11 by the brush roller 52. The lubricant agent 57 has a rectangular solid shape whose length of the longitudinal direction is substantially equal to the length of the photo conductor 11.

The lubricant agent 57 is biased to the side of the brush roller 52 by the biasing member 58 formed of a spring or the like. With this structure, the brush roller 52 securely scrapes the lubricant agent 57 and applies it to the photo conductor 11 regardless of the residue amount of the lubricant agent 57. Further, the lubricant agent 57 is exchangeable when it runs out.

The lubricant agent 57 may be realized by fatty acid metal salt, fluorocarbon resin or the like known as a metal soap. Examples of fatty acid metal salt includes zinc stearate (zinc stearate), copper stearate, iron stearate, magnesium palmitate, zinc oleate, calcium palmitate, manganese oleate, lead oleate or the like which are fatty acid metal salt with relatively long chains.

The brush roller 52 is a tube-shaped brush substantially the same in length (width) as the photo conductor 11. The brush roller 52 is positioned with its bristles in contact with the surface of the photo conductor 11, having its axis in parallel with the axis of the photo conductor 11.

Further, the brush roller 52 is rotated by driving means (not shown) such as a motor or a gear in the reverse direction to the rotation of the photo conductor 11. With this arrangement, the brush roller 52 scrapes the lubricant agent 57 provided more upstream in terms of brush circumference direction than the contact point with the photo conductor 11, and then supplies the lubricant agent to the photo conductor 11. Note that, the lubricant agent scraped by the brush roller 52 is supplied to the surface of the photo conductor 11 as fine particles.

By thus applying fine particles of the lubricant agent 57 on the surface of the photo conductor 11, the friction coefficient of the blade 51 and the surface of the photo conductor 11 is reduced, toner adhesion photo conductor 11, and the toner adhesion by the blade 51 can be efficiently performed.

With the structure above, in the visible image forming unit, the charging device 12 charges the surface of the photo conductor 11, and the surface of the photo conductor 11 is exposed by the laser light irradiating means 13 to form an electrostatic latent image thereon, an electrostatic latent image formed on the photo conductor 11 is then developed by the development device 14, and the resulting toner image is transferred to a recording paper by the transfer roller 15. Further, the residue toner image on the surface of the photo conductor 11 after the transfer to the recording paper is collected by the cleaner unit 16. This transfer of toner image to the recording paper is carried out in each visible image forming unit, so that plural toner images of different colors are transferred onto a recording paper, layered on each other.

The recording paper carrying means 30 is made of a driving roller 31, an idling roller 32, and a carriage belt 33. The recording paper carrying means 30 serves to carry recording papers to the visible image forming units to allow transfer of plural toner images of different colors onto each recording paper. The driving roller 31 and the idling roller 32 suspends an endless carriage belt 33. The carriage belt 33 is rotated by the rotation of the driving roller 31 at a predetermined circumferential velocity. The external surface of the carriage belt 33 is charged to a predetermined potential, thereby carrying a recording paper electrostatically adhered thereto.

The recording paper is thus carried by the recording paper carrying means 30, and have a toner image (unfixed toner image) transferred thereon as it passes through the visible image forming units. The recording paper is then removed from the carriage belt 33 by the curvature of the driving roller 31, to be carried to the fixing device 40. The fixing device 40 applies appropriate degree of heat and pressure to the recording paper to dissolve the toner on the recording paper, thereby fixing the toner image onto the recording paper, before discharging the recording paper to a discharge tray (not shown).

The following describes a structure of the charging device 12.

As shown in FIG. 1, the charging device 12 includes a charging roller 61 and a cleaning member 62.

The charging roller 61 serves to evenly charge the surface of the photo conductor 11 by a direct-current voltage supplied from a power source (not shown). The charging roller 61 is substantially identical in length to the axis direction of the photo conductor 11, and is positioned so that it comes in contact with the surface of the photo conductor 11 with the axis in parallel to the axis of the photo conductor 11. The charging roller 61 is rotatably supported by an axis, and is rotated due to the driving force of the photo conductor 11 which is transmitted from the photo conductor 11 as the charging roller comes in contact with the surface of the photo conductor 11.

Figure 3:
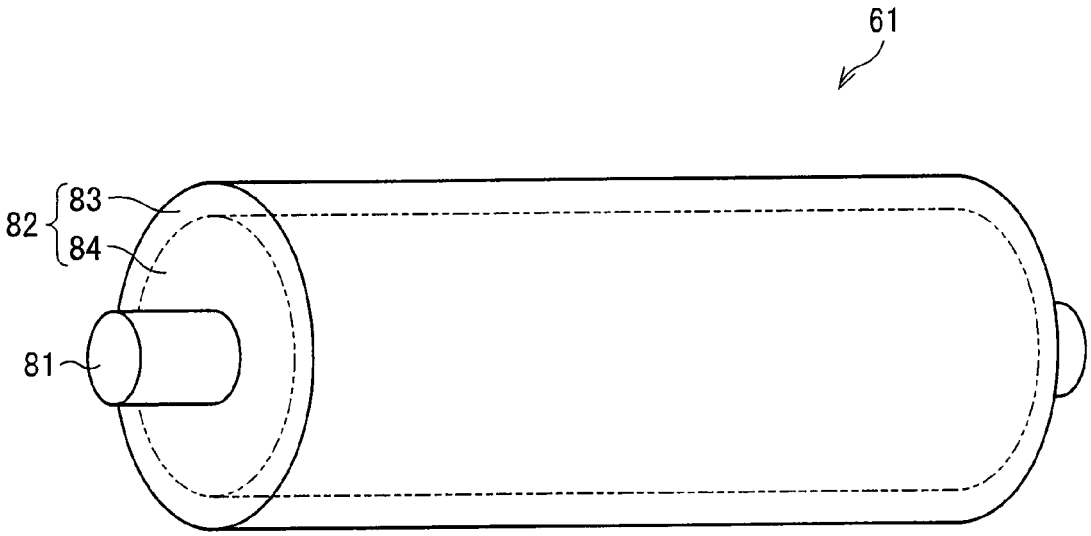
FIG. 3 is a perspective view illustrating a structure of a charging roller in an image forming apparatus according to one embodiment.

FIG. 3 is a perspective view of the charging roller 61.

As shown in the figure, the charging roller 61 is made of a column-shaped cored bar and a rubber layer (elastic layer) 82 formed on the periphery of the cored bar 81. The rubber layer 82 includes a processed region 83 and an unprocessed region 84. The processed region 83 is closer to the surface of the charging roller 61 while the unprocessed region 84 is closer to the cored bar 81.

The cored bar 81 is a stainless round bar 8 mm in diameter. The cored bar 81 is however not limited to this form and may be a bar of other conductive metal, such as iron, copper, aluminum, or nickel. A direct current is applied to the cored bar 81 to charge the photo conductor 11.

The rubber layer 82 6.5 mm in thickness is made of an epichlorohydrin rubber. In the present embodiment, the rubber layer 82 6.5 mm in thickness made of an epichlorohydrin rubber was formed around the cored bar 81. The rubber layer 82 was made by being subjected to heating after a surface treatment agent containing isocyanate compound, acrylic fluorine-based polymer and acrylic silicone-based polymer was sprayed thereto. The outer layer of the rubber layer 82 impregnated with the surface treatment agent serves as a processed region 83, and the inner layer of the rubber layer 82 not impregnated with the surface treatment agent serves as an unprocessed region 84. Therefore, there is no clear border between the processed region 83 and unprocessed region 84. This surface treatment prevents exudation of an ion conductive agent or the like from the rubber layer 82, thereby preventing stains on the photo conductor 11 by the agent.

Further, in the present embodiment, the charging roller 61 subjected to surface treatment was further treated by corona discharge treatment (explained later) for five minutes. The contact angle of water of the charging roller 61 having been through corona discharge treatment was 87°.

The cleaning member 62 is provided in contact with the surface of the charging roller 61, and removes toner, paper dust, and extra lubricant agent from the surface of the charging roller 61. The cleaning member 62 may be made of a felt, sponge, mylar sheet, etc. Note that, the shape of the cleaning member 62 is not limited, and may be a roller, a plate or a sheet.

Note that, a separation/connection mechanism (not shown) may be provided to switch the position of the cleaning member 62 between a portion in contact with the charging roller 61 and a portion separated from the charging roller 61.

The form of the separation/connection mechanism is not limited. For example, the cleaning member 62 may be moved by rotation of its support base (support member) due to driving force supplied from a drive source such as a motor. Alternatively, the cleaning member 62 or its support base may be in contact with an eccentric cam (not shown), and the charging roller 61 and the cleaning member 62 may be separated by controlling rotation of the eccentric cam. Otherwise, they may be separated by an actuator (not shown) made of solenoid or the like.

With this separation/connection mechanism, the cleaning member 62 may be connected and separated to/from the charging roller 61 depending on necessity of cleaning. With this mechanism, ablation of the charging roller 61 by the cleaning member 62 can be prevented.

Figure 4:
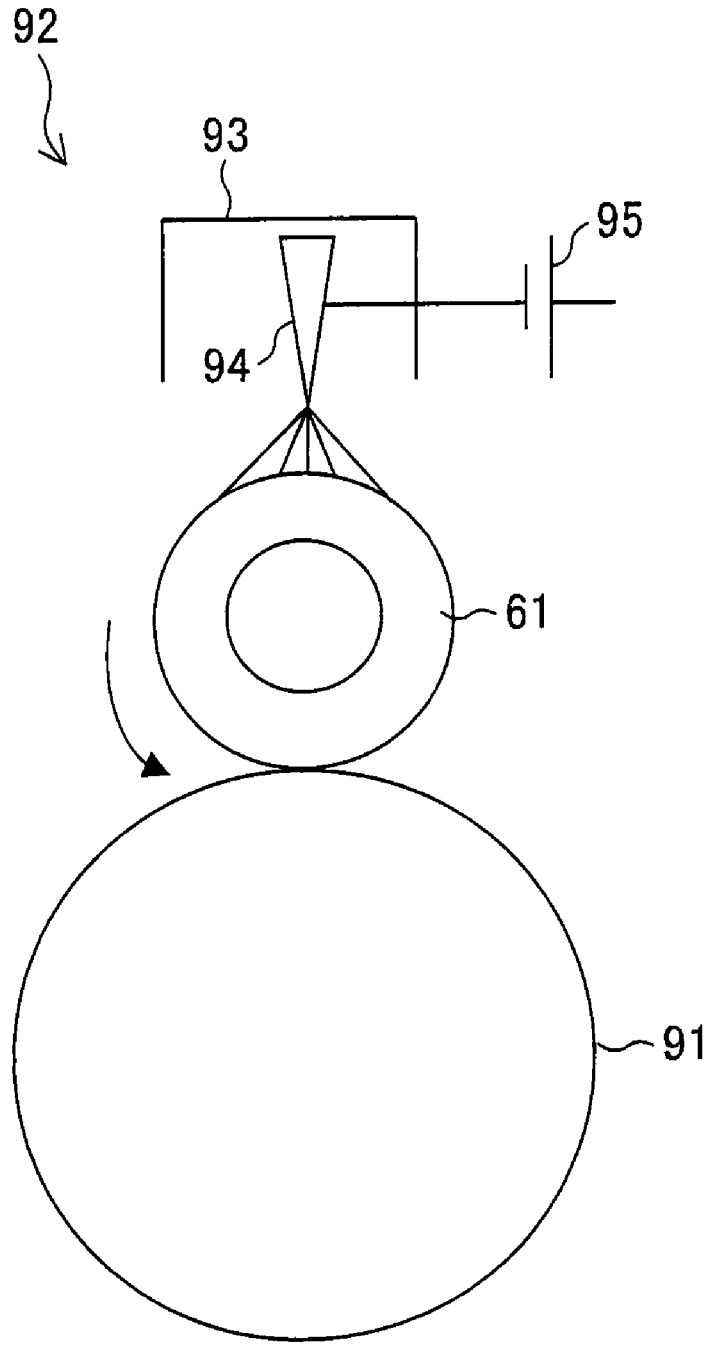
FIG. 4 is an explanatory view illustrating a structure of a charging roller production apparatus according to one embodiment.

Next, the following explains the foregoing corona discharge treatment to the charging roller 61. FIG. 4 is an explanatory view showing a structure of a charging roller production apparatus 92 used for the corona discharge treatment to the charging roller 61.

As shown in the figure, the charging roller production apparatus 92 includes an insulating drum (discharge section, discharge electrode) 91, a corona discharger (discharge section), and a power source 95.

The insulating drum 91 is a cylindrical drum substantially the same in length as the charging roller 61. At least the surface of the insulating drum 91 is made of an insulating material. The insulating drum 91 is rotated by driving means (not shown) such as a motor or a gear. The charging roller 61 is supported by a casing (not shown) or the like of the charging roller production apparatus 90 to be rotatable about the casing, and is positioned so that its surface comes in contact with the surface of the charging roller 61 with the axis (longitudinal side) in parallel to the axis of the charging roller 61. With this structure, the charging roller 61 is rotated due to the driving force of the insulating drum 91 which is transmitted from the insulating drum 91 as the charging roller comes in contact with the surface of the insulating drum 91.

The corona discharger includes a casing 93, and a discharge electrode 94 contained in the casing 93.

The casing 93 extends in a direction substantially parallel to the charging roller 61, and its cross-section vertical to the extension direction is substantially a square with an open side facing to the charging roller 61. In the present embodiment, the casing 93 is formed of a stainless material.

The discharge electrode 94 is supplied with a voltage from the power source 95 and generates corona discharge between itself and the charging roller 61. In the present embodiment, the discharge electrode 94 is formed as a serration electrode which is formed of a metal plate (stainless etc.) substantially the same in length as that of a charging roller 61, one side of which has a serration. The edge of the serration part faces to the charging roller 61. However, the discharge electrode 94 is not limited to this structure. For example, the discharge electrode 94 may be a member formed of many needles of a metal material or the like in which the needles are aligned along the extension direction of the charging roller 61 with their edges facing to the charging roller 61. Alternatively, the discharge electrode 94 may be made of a wire disposed in parallel with the charging roller 61.

The power source 95 serves to apply a voltage to the discharge electrode 94, so as to allow the discharge electrode 94 to generate corona discharge between the discharge electrode 94 and the charging roller 61.

A control electrode (grid electrode) may be provided between the discharge electrode 94 and the charging roller.

In the present embodiment, the rotation number of the insulating drum 91 is determined so that the surface of the charging roller 61 is rotated at 24 mm/s. The gap between the teeth edges of the serration section in the discharge electrode 94 and the charging roller 61 is set to 5 mm.

A voltage of −4.5 kV was applied to the discharge electrode 94, which resulted in −800 μA of corona discharge current in total from the electrode 94 to the charging roller 61 and the casing 93.

Figure 5:
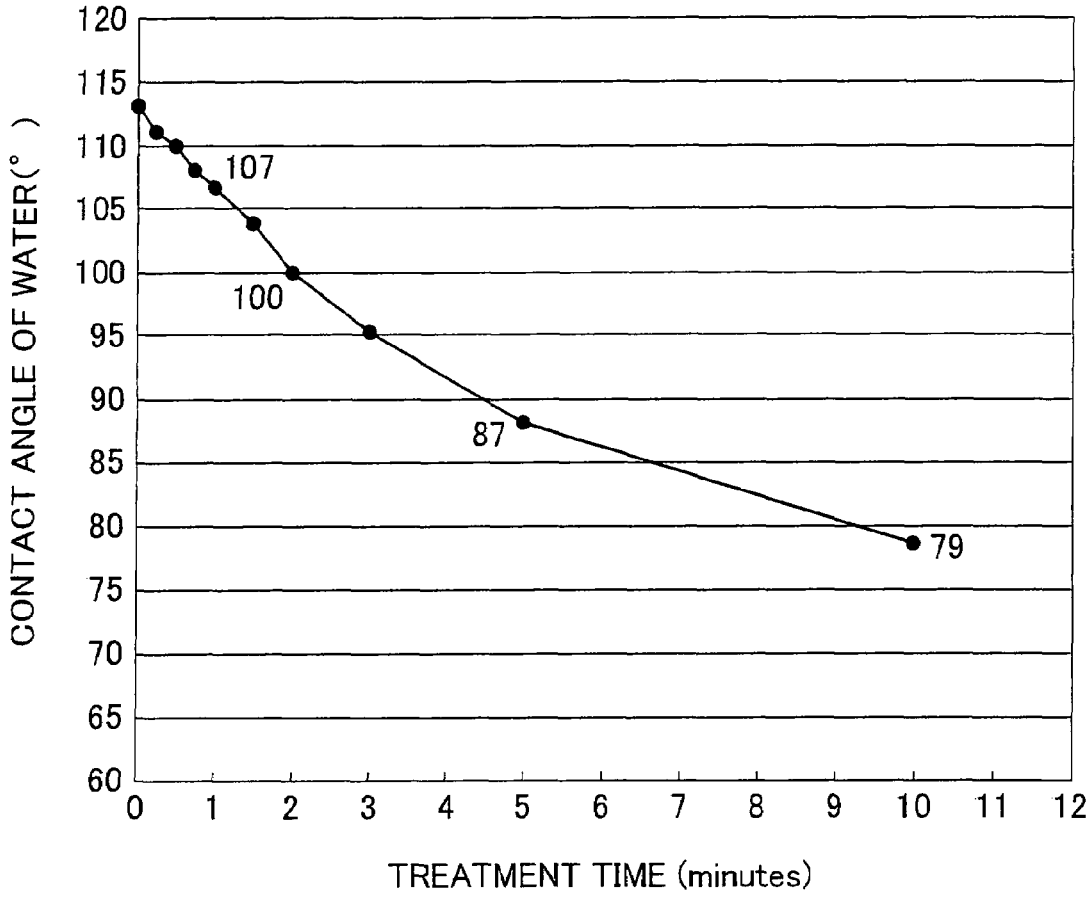
FIG. 5 is a graph showing a relationship between a time of corona discharge treatment and a contact angle of water on the surface of a charging roller in the case of using the charging roller production apparatus of FIG. 4.

FIG. 5 is a graph showing a relationship between a time of corona discharge treatment and a contact angle of water on the surface of the charging roller 61. As shown in the figure, the contact angle of water of the surface of the charging roller 61 was about 112° before the corona discharge treatment, but it decreases as the treatment time advances. After two minutes from the start of treatment, the contact angle of water becomes 100° which is the same as that of the photo conductor 11, and as the treatment further advanced, it finally fell below that of the photo conductor 11. In the present embodiment, as described above, the corona discharge treatment was carried out for five minutes, so that the contact angle of water on the surface of the charging roller 61 became 87°. In this manner, by carrying out corona discharge treatment for a period according to the following formula, the contact angle of water of the surface of the charging roller 61 is securely set equal to or below 100°.

$$t > 1.82 \times A$$

(t expresses the time for treating the charging roller 61, and A expresses a diameter of the charging roller 61)

The contact angle of water is further decreased as the treatment time t increases.

The following explains a result of an experiment for examining the relationship between the contact angle of water on the surface of the charging roller 61, and slip of the rotation of the charging roller 61 in the rotation due to the driving force of the photo conductor 11 which is transmitted from the photo conductor 11 as the charging roller comes in contact with the surface of the photo conductor 11.

In this experiment, the contact angle of water on the surface of the photo conductor 11 was set to 100°.

Further, the charging roller 61 forms a rubber layer 6.5 mm in thickness made of an epichlorohydrin rubber around a stainless shaft 8 mm in diameter, and the surface was processed (a surface treatment agent was sprayed to the rubber layer until the roller was fully impregnated with the agent, and the roller was then heated). The time for treating the corona discharge treatment was varied so as to vary the contact angle of water on the surface of the charging roller 61.

Table 1 shows a slip ratio on the surface of the charging roller 61 and occurrence of black-stripe image defect for differing contact angles of water on the surface of the charging roller and process speeds (movement speed on the surface of the photo conductor 11) of the image-forming apparatus 1. Here, the slip ratio is a value obtained by dividing the difference between a movement speed V11 on the surface of the photo conductor 11 and a movement speed V61 on the surface of the charging roller 61 by a movement speed V11 on the surface of the photo conductor 11, that is expressed as: (V11−V61)/V11. Further, as for the image defect appearing as black stripe, the degree of image defect on the recording paper after the image forming was evaluated by eyes. The result was shown as five-grade evaluation in Table 1, where "◎" expresses a state completely immune to image defect, "○" expresses a state having a little image defect which was hardly seen by eyes, "Δ" expresses a state having a little image defect which was not so significant in eyes observation, "x" expresses a state having explicit image defect, "xx" expresses a state having significant image defect.

TABLE 1

| CONTACT ANGLE OF WATER (°) | | PROCESS | SLIP | GENERATION |
|---|---|---|---|---|
| PHOTO CONDUCTOR | CHARGING ROLLER | SPEED (mm/S) | RATIO (%) | OF BLACK STRIPES |
| 100 | 112 | 122 | 0.5 | "○" |
| 100 | 112 | 173 | 0.8 | "Δ" |
| 100 | 112 | 280 | 1.1 | "X" |
| 100 | 112 | 355 | 1.8 | "XX" |
| 100 | 105 | 355 | 1 | "X" |
| 100 | 100 | 355 | 0.5 | "○" |
| 100 | 87 | 355 | 0.1 | "◎" |
| 100 | 79 | 355 | 0 | "◎" |

As shown in the figure, on condition that the contact angle of water on the surface of charging roller is 112°, the slip ratio was 0.5% when the process speed was 122 mm/s. The image defect of black stripes was not visible at this stage. However, under a process speed of 173 mm/s, the slip ratio was increased to 0.8%, and the image defect of black stripes became visible. Then, under a process speed of 280 mm/s, the slip ratio became 1.1%, and the image defect of black stripes became explicit. Further, under a process speed of 355 mm/s, the slip ratio was increased to 1.8%, and the image defect of black stripes became significant.

On the other hand, the contact angle of water on the surface of charging roller was varied to 105°, 100°, 87°, and 79° under a process speed of 355 mm/s, and the slip ratio and the image defect were examined. The slip ratio under these conditions were 1%, 0.5%, 0.1%, and 0%, respectively. As for the image defect, the image defect did not occur at all or was so small that it was invisible when the contact angle of water on the surface of charging roller was at or less than 100°, that is, the contact angle of water on the surface of the charging roller is equal to or below the contact angle of water on the surface of the photo conductor 11.

This experiment result showed that the grip force between the charging roller and the photo conductor 11 can be increased by setting the contact angle of water on the surface of the charging roller to be equal to or below the contact angle of water on the surface of the photo conductor 11. On this account, the occurrence of slip is suppressed.

As described, an image forming apparatus according to the present embodiment is arranged so that the contact angle of water of the surface of the charging roller 61 is equal to or less than that of the surface of the photo conductor 11. On this account, the grip force between the charging roller 61 and the photo conductor 11 can be increased, and slip of the charging roller 61 can be presented even under a high-speed process. Therefore, image defect of black stripes can be prevented.

In the case where only a direct current is applied to the charging roller on image forming, the image defect of black stripes due to the slip of charging roller appears more significantly. However, the slip of the charging roller 61 is securely prevented in the image forming apparatus 1 of the present embodiment, and therefore the image defect of black stripes due to the slip of charging roller does not significantly appear even in the case where only a direct current is applied to the charging roller on image forming. Note that, in the present embodiment, a direct current is applied to the charging roller 61 on image forming, but the present technology is not limited to this. For example, an alternating current may be superimposed on a direct-current voltage. Further, an alternating current may be applied at a time where image forming is not performed, i.e. before or after image-forming. The voltage application to the charging roller using a voltage in the same polarity as that of contaminant of toner etc. adhered to the surface of the charging roller serves as electrostatic cleaning of the charging roller.

Further, in the present embodiment, a lubricant agent is applied to the surface of the photo conductor 11. On this account, the surface energy of the photo conductor 11 decreases, and ablation caused by the cleaning blade of the photo conductor 11, or adhesion of contaminants of toner etc. on the surface of the photo conductor 11 can be reduced.

Also, transition of the lubricant agent from the surface of the photo conductor 11 to the surface of the charging roller 61 causes a decrease in surface energy of the charging roller 61. Consequently, adhesion of contaminants of toner etc. on the surface of the photo conductor 11 can be reduced.

Note that, in the present embodiment, the lubricant agent is applied on a portion more downstream than the portion opposite to the transfer roller 15 and the photo conductor 11 along the rotation direction of the photo conductor 11, and more upstream than the portion opposite to the cleaning blade 51 and the photo conductor 11, but the point of application lubricant agent is not limited. For example, after passing the cleaning blade 51, the lubricant agent may be applied to the surface of the photo conductor 11 before it comes in contact with the charging roller 61. Further, the lubricant agent may be applied to the surface of the charging roller 61 so that the lubricant agent is transferred from the charging roller 61 to the photo conductor 11. Further, the lubricant agent may be applied to plural portions on the photo conductor 11 and/or on the surface of the charging roller 61.

Further, the charging device 12 may include cleaning means for removing extra lubricant agent and contaminant adhered to the surface of the charging roller 61. This provision prevents leak of the current applied from the charging roller to the photo conductor 11 due to adhesion of lubricant agent to the surface of the charging roller 61. Moreover, the removal of contaminant from the surface of the charging roller 61 also gives an effect of preventing uneven charging.

Further, in the present embodiment, the rubber layer 82 is made of a surface-treated epichlorohydrin rubber, but the structure of rubber layer 82 is not limited to this form. Another suitable conditions of rubber layer 82 may be elasticity enough to evenly brings the charging roller 61 to be in close contact with the photo conductor 11, an appropriate electric resistance to evenly charge the surface of the photo conductor 11, and a contact angle of water on the surface of the photo conductor 11 equal to or less than the contact angle of water on the surface of the photo conductor 11, or a surface processed (eg. by corona discharge treatment) to have a contact angle of water equal to or less than the contact angle of water on the surface of the photo conductor 11.

Examples of suitable material of elastic layer 82 includes a rubber material such as natural rubber, ethylenepropylene rubber (EPDM), styrenebutadiene rubber (SBR), silicone rubber, urethane rubber, isoprene rubber(IR), butadiene rubber(BR), nitryl butadiene rubber(NBR), chloroprene rubber (CR), polyamide resin, polyurethane resin, or an elastic material such as silicone resin, appropriately mixed with a conducting agent having an electron electromagnet mechanism such as carbon black, graphite, or conductive metal oxide, or a conducting agent having an ion conduction mechanism such as alkali metal salt, quaternary ammonium salt or the like.

Moreover, the elastic layer 82 of one of the listed materials may be processed by surface treatment. A suitable surface treatment agent may contain isocyanate compound, acrylic fluorine-based polymer, acrylic silicone-based polymer, or the like. Further, a conducting agent such as carbon black may be added as required. Suitable examples of the isocyanate compound include 2,6-tolylene diisocyanate(TDI), 4,4'-diphenylmethane diisocyanate(MDI), para-phenylene diisocyanate (PPDI), 1,5-naphthalene diisocyanate(NDI) and 3,3-dimethyl diphenyl-4,4'-diisocyanate(TODI) and multimeric or degenerated compounds of those.

Further, suitable acrylic fluorine-based polymer and acrylic silicone-based polymer are soluble to a predetermined agent, and are bonded with the isocyanate compound through chemical reaction. More specifically, the acrylic fluorine-based polymer is a medium-soluble fluoropolymer containing a hydrogen group, an alkyl group, or a carboxyl group. Suitable examples of the acrylic fluorine-based polymer include acrylic acid ester, acrylic acid alkyl fluoride block copolymer and derivatives thereof. Further, an acrylic silicone-based polymer is a medium-soluble silicone polymer, for example, an acrylic acid ester, acrylic acid siloxane ester block copolymer and derivatives thereof. Note that, the surface treatment is not always necessary. An elastic layer 82 of a material with an untreated surface is also useful.

A resistive layer may be provided on the front surface of the elastic layer 82. The resistive layer may be formed of epichlorohydrin rubber, NBR, polyolefin-based thermoplastic elastomer, urethane-based thermoplastic elastomer, polystyrene-based thermoplastic elastomer, fluorocarbon-based rubber thermoplastic elastomer, polyester-based thermoplastic elastomer, polyamide-based thermoplastic elastomer, polybutadiene-based thermoplastic elastomer, ethyleneacetic acid vinyl-based thermoplastic elastomer, polyvinyl-based thermoplastic elastomer, chlorinated polyethylene-based thermoplastic elastomer, or a mixture of those; or a copolymer material appropriately mixed with a conducting agent having an electron electromagnet mechanism (eg. conductive carbon, graphite, conductive metal oxide, copper, aluminum, nickel, iron powder) or a conducting agent having an ion conduction mechanism (eg. alkali metal salt, ammonium salt etc.). It should be noted that the material of the resistive layer is selected in view of providing a contact angle of water on the surface of the resistive layer (the surface of the charging roller 61) equal to or less than the surface of the photo conductor 11. Otherwise, the resistive layer is processed (eg. by corona discharge treatment) to have the contact angle of water to be equal to or less than the contact angle of water on the surface of the photo conductor 11.

The voltage applied to the discharge electrode of the corona discharger 92 is not particularly limited. A suitable voltage is selected to carry out corona discharge treatment for an appropriate time so that the contact angle of water on the surface of the charging roller 61 becomes a predetermined angle, i.e. equal to or smaller than the contact angle of water of the photo conductor 11.

Further, in the present embodiment, the corona discharger 92 is disposed on a portion opposite to the charging roller 61, and corona discharge is generated between the corona discharger 92 and the charging roller 61. However, the present technology is not limited to this.

Figure 6:
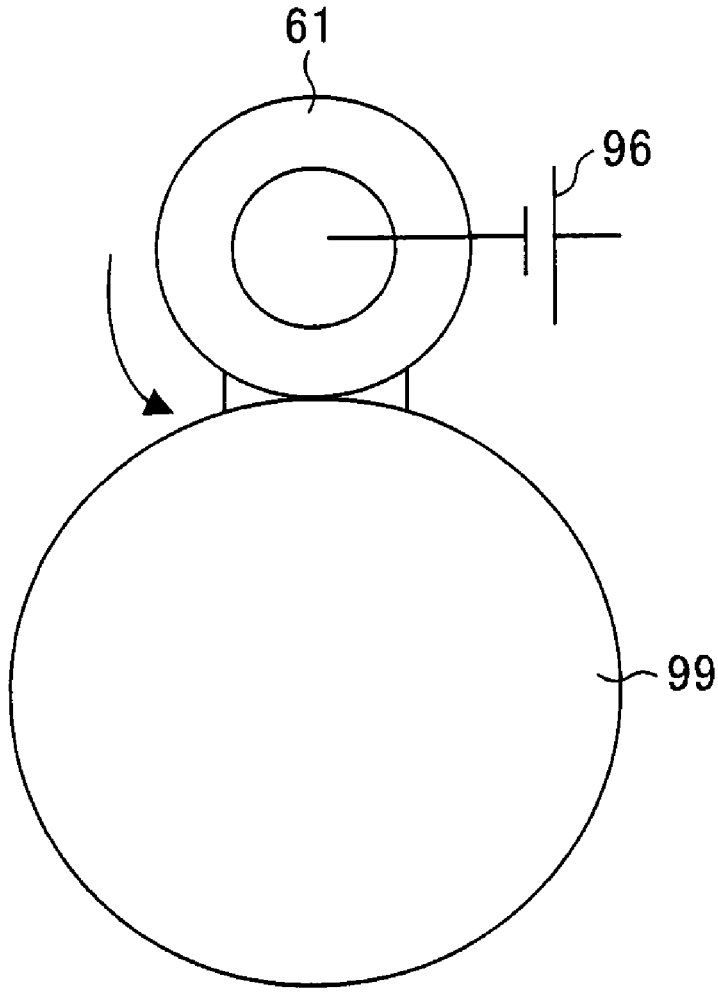
FIG. 6 is an explanatory view illustrating a modification of the charging roller production apparatus according to one embodiment.

An alternative structure is shown in FIG. 6. In this case, the charging roller 61 and the drum 99 are brought in contact with each other, and the charging roller 61 is rotated due to the driving force of the drum 99 which is transmitted from the drum 99 as the charging roller comes in contact with the surface of the drum 99. The discharge voltage is thus applied from the power source 96 to the charging roller 61. Note that, the drum 99 may have the same structure as that of the photo conductor 11. With this structure, corona discharge is generated between the charging roller 61 and the drum 99 (upstream and downstream portions of the contact point between the charging roller 61 and the drum 99 in the rotation direction of the drum 99).

Figure 7:
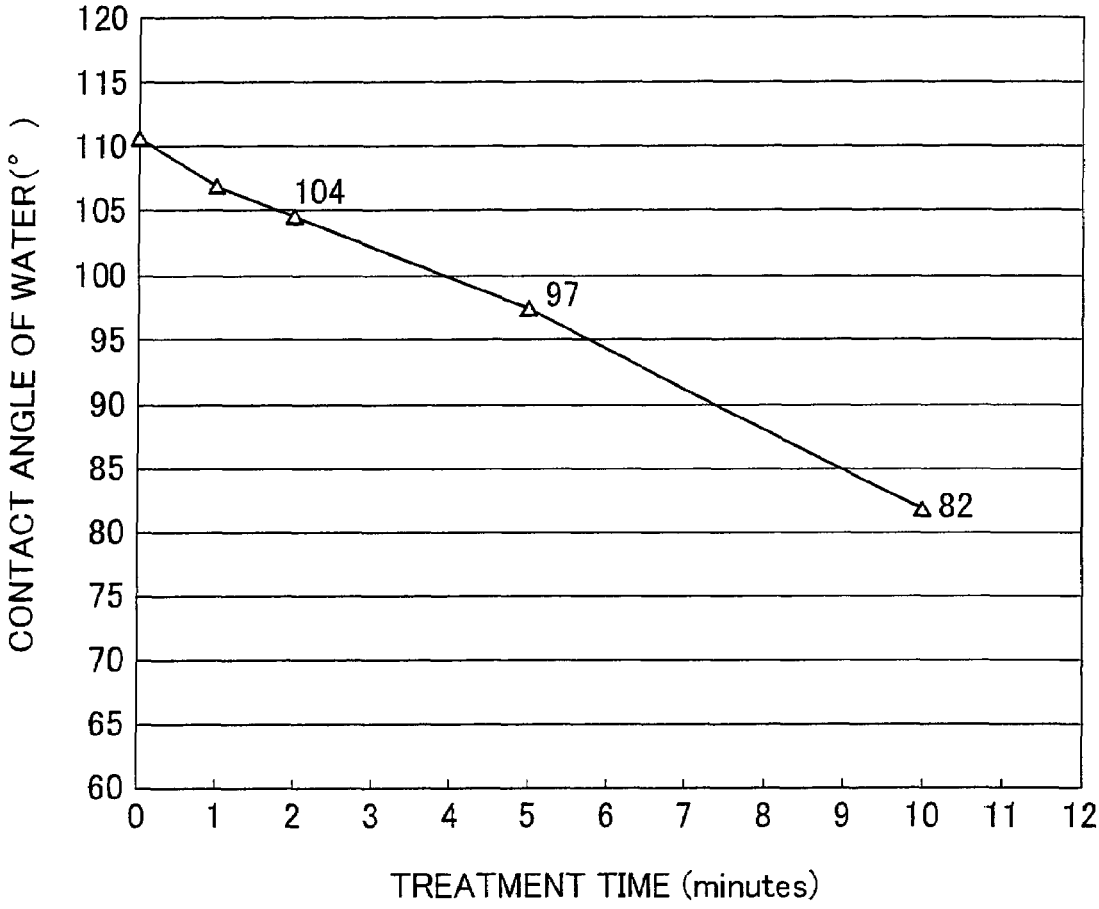
FIG. 7 is a graph showing a relationship between a time of corona discharge treatment and a contact angle of water on the surface of a charging roller in the case of using the charging roller production apparatus of FIG. 6.

FIG. 7 is a graph showing a relationship between a contact angle of water on the surface of the charging roller 61 and a process time on condition that the drum 99 is rotated (surface movement speed of the drum 99) at 450 mm/s, a discharge voltage to be applied to the charging roller 61 is set to −1.25 kV, and the discharge current from the charging roller 61 to the drum 99 is −80 μA. As shown in the figure, the contact angle of water decreases as the process time decreases, and the contact angle of water fell to or below 100° in 4 minutes.

Second Embodiment

Another embodiment is explained below. For ease of explanation, materials having the equivalent functions as those shown in the drawings pertaining to the foregoing First Embodiment will be given the same reference symbols, and explanation thereof will be omitted here.

Figure 8:
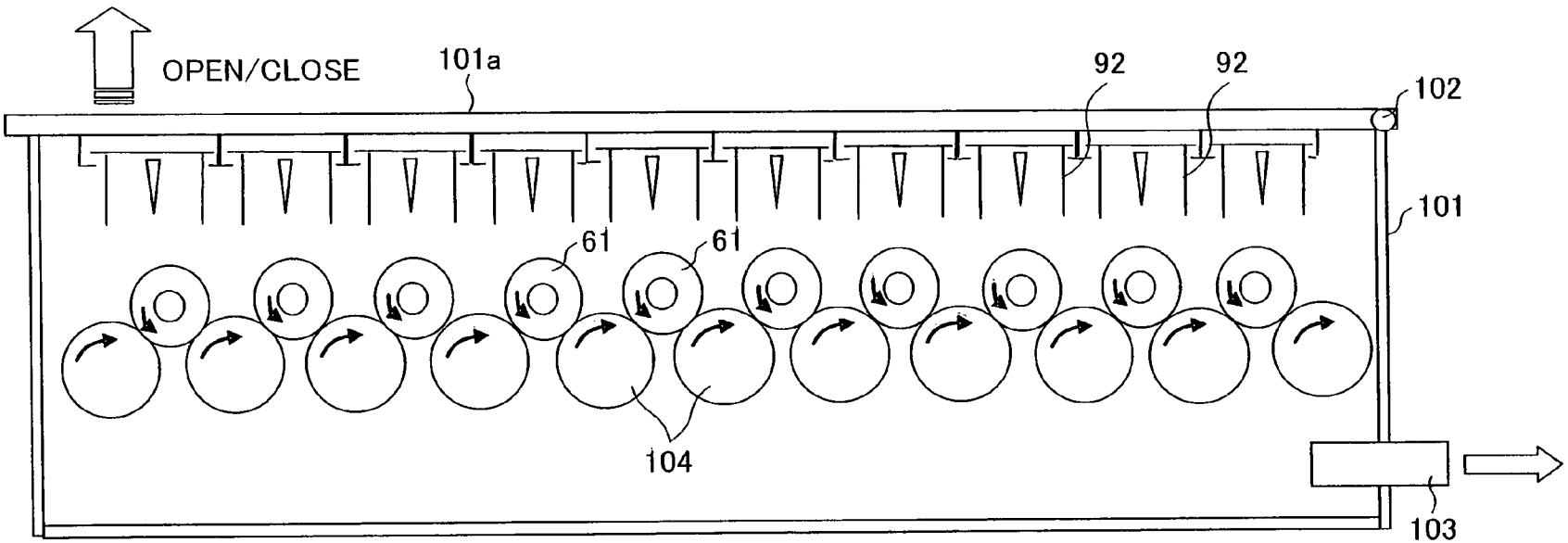
FIG. 8 is an explanatory view illustrating a structure of a charging roller production apparatus according to another embodiment.

The present embodiment describes a charging roller production apparatus capable of efficiently carrying out corona discharge treatment with respect to a plurality of charging rollers 61. FIG. 8 is a cross-sectional view showing a structure of a charging roller production apparatus 100 according to the present embodiment.

As shown in the figure, the charging roller production apparatus includes a casing (shielding member) 101, a lid rotating axis 102, an ozone discharge outlet 103, a large number of rotation rollers (roller member, rotation section) 104, and a large number of corona dischargers 92.

The casing 101 contains the rotation roller 104 and the corona discharger 92. The lid section (shielding member) 101*a* of the casing 101 is rotatable about a lid rotating axis 102, which opens or closes the casing 101. An ozone discharge outlet 103 is provided in a part of the casing 101.

An ozone filter (not shown) is provided in the ozone discharge outlet 103 or in a discharge end through the ozone discharge outlet 103, so as to remove ozone resulted from the corona discharge. Note that, on the corona discharge treatment, the ozone discharge outlet 103 may be closed to seal up the casing 101. In this case, the ozone discharge outlet 103 is opened after the corona discharge treatment to discharge ozone from the casing 101.

The rotation rollers 104, similar in length to the charging roller 61, hold the charging rollers 61. More specifically, each rotation roller 104 is a stainless round bar which is supported by axes which are lateral sides of the casing 101. The rotation rollers 104 are rotated by driving means (not shown). The rotation rollers 104 are adjacently formed in parallel in the horizontal direction with a predetermined gap therebetween (eg. 30 mm gap between the axes). With this arrangement, the charging rollers 61 are placed on and in contact with two adjacent rotation rollers 104. The rotation rollers 104 are rotated in the same direction, and the charging rollers 61 are rotated due to the driving force of the rotation rollers 104 which is transmitted from the rotation rollers 104 as the charging rollers come in contact with the surfaces of the rotation rollers 104. Note that, the external diameters of the rotation rollers 104 and the gap between the two adjacent rotation rollers 104 are determined to appropriate values with which the charging rollers 61 can be rotated along the circumference direction, while being controlled in their movements in a direction vertical to the axis.

A large number of corona dischargers 92 are provided on an internal face of the lid section 101*a*. When the lid section is closed, the corona dischargers 92 come opposite to the charging rollers 61 provided on the rotation rollers 104 with predetermined gaps (eg. 10 mm).

As described, the charging roller production apparatus 100 rotatably holds a plurality of charging rollers 61. The charging roller production apparatus 100 includes a plurality of corona dischargers 92 opposite to the charging rollers 61. With this structure, the corona discharge treatment can be carried out to a plurality of charging rollers 61 at the same time. This increases the productivity.

Further, since the charging rollers 61 are rotated due to the driving force of the rotation rollers 104 which is transmitted from the rotation rollers 104 as the charging rollers come in contact with the surfaces of the rotation rollers 104, the corona discharge treatment can be carried out to the charging rollers 61 being rotated. Therefore, the corona discharge treatment can be carried out evenly to the surfaces of the charging rollers 61.

Further, in the charging roller production apparatus 100, the components are contained in the casing 101 to be shielded from the surrounding space. With this arrangement, the corona discharge can be generated in a closed space. In this manner, the ozone resulted from the corona discharge is not diffused into the surrounding space.

Third Embodiment

Another embodiment is explained below. For ease of explanation, materials having the equivalent functions as those shown in the drawings pertaining to the foregoing First or Second Embodiment will be given the same reference symbols, and explanation thereof will be omitted here.

Figure 9:
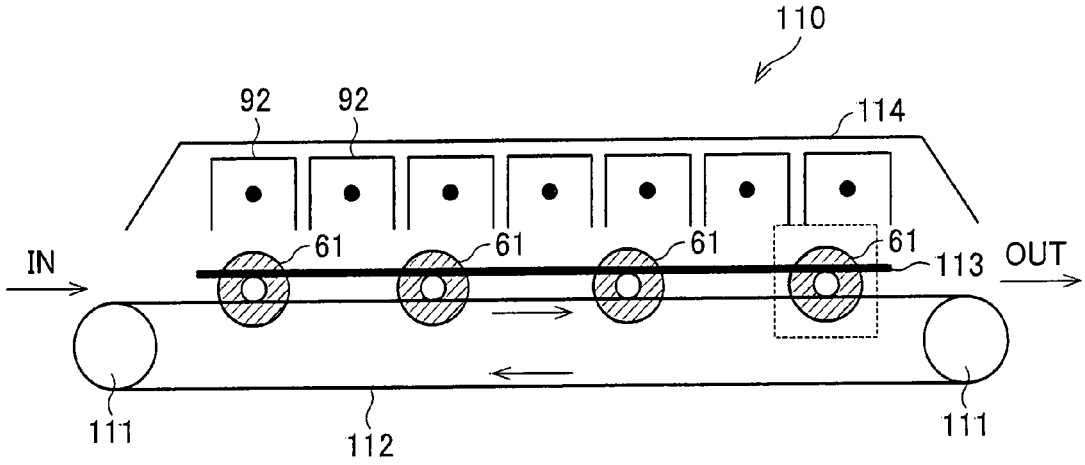
FIG. 9(*a*) is an explanatory view illustrating a structure of a charging roller production apparatus according to still another embodiment.
Figure 9:
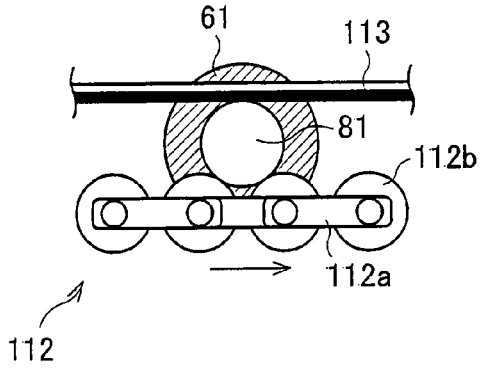
Figure 10:
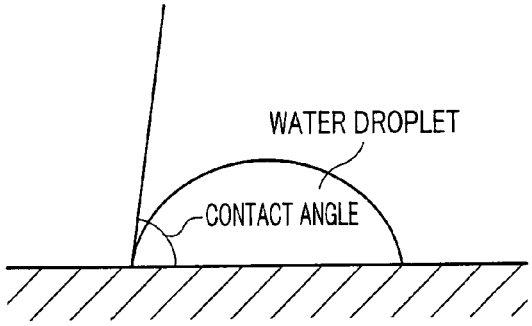
FIG. 10 is an explanatory view for explaining a contact angle of water.

The present embodiment describes a charging roller production apparatus capable of more efficiently carrying out corona discharge treatment with respect to a plurality of charging rollers 61. FIG. 9(*a*) is a cross-sectional view showing a structure of a charging roller production apparatus 110 according to the present embodiment.

As shown in the figure, the charging roller production apparatus 110 includes two sprockets (hold section, carriage section, supporting members) 111, the chain (hold section, endless member) 112 set on the sprockets 111, and the high friction member (contact member, rotation section) 113 provided above and opposite to the chain 112, and the corona dischargers 92 provided above and opposite to the friction member 113. Note that, two groups consisting of the sprockets 111, the chain 112, and the high friction member 113 are provided respectively on the side into the plane of FIG. 9(*a*) and on the side out of the plane of FIG. 9(*a*) (both sides of the charging rollers 61).

With this arrangement, the cored bar 81 projected from the two sides of each charging rollers 61 are placed (held) on the chain 112 as the charging rollers are carried onto the chain 112. Rotation of the sprockets 111 driven by driving means (not shown) such as a motor makes the chain 112 rotates, so that the chain 112 moves around the two sprockets 111. With this arrangement, the charging rollers 61 on the chain 112 are carried outward via the region opposite to the corona dischargers 92.

FIG. 9(*b*) is a magnified view of the part of the FIG. 9(*a*) denoted by the broken line. As shown in the figure, the chain 112 includes many roller sections (hold section, regulation section) 112*b* and a link section 112*a* for connecting two adjacent roller sections 112*b*. The charging rollers 61 are placed on the two adjacent roller sections 112*b* so that each of the cored bars 81 come in contact with both of the two roller sections 112*b*. With this arrangement, the charging rollers 61 are rotatably held on the chain 112. Also, this arrangement prevents transition of the relative position of the charging rollers 61 to the chain 12 by the roller sections 112*b* into the direction vertical to the axis direction of the charging rollers 61. Further, the upper surfaces of the charging rollers 61 come in contact with the high friction member 113. With this arrangement, the charging rollers 61 are carried to the transition direction of the chain 112, each rotating about a corresponding cored bar 81 along the circumference direction.

Note that, any member having an appropriate frictional property is suitable for the high friction member 113. With such a property, the high friction member 113 gives a frictional force to the charging rollers 61 into a direction reverse to the carriage direction of the charging rollers 61, as it comes in contact with the upper surfaces of the charging rollers 61. Consequently, the charging roller 61 is rotated along the circumference direction.

As described, the charging roller production apparatus 110 includes sprockets 111 and the chain 112 serving as carrying means for carrying the charging rollers 61; and corona dischargers 92 for carrying out corona discharge treatment to the surfaces of the charging rollers 61.

With this structure, the charging roller production apparatus 110 is capable of processing the charging rollers 61 being carried. Therefore, by carrying a plurality of charging rollers 61, the charging rollers 61 can be sequentially subjected to corona discharge treatment. This increases productivity.

Further, by the contact of the cored bars 81 of the charging rollers 61 being carried with the roller sections 112*b* of the chain 112, the charging rollers 61 being carried are also rotated about the cored bars 81. With this arrangement, it is possible to evenly carry out corona discharge treatment to the surface of the charging rollers 61.

Note that, the carriage speed of the charging rollers 61 (rotation speed of the sprockets 111), the installation number of the corona dischargers 92, the number of discharge electrodes in each corona discharger 92, and the width of the carriage direction of the charging rollers 61 in the region for carrying out corona discharge treatment to the charging rollers 61 by the corona dischargers 92 are determined to appropriate values with which the charging rollers 61 are passed through the region opposite to the corona dischargers 92 for an appropriate time so that the contact angle of water on each of the surfaces of the charging rollers 61 is set not more than a predetermined angle (eg. the contact angle of water of the photo conductor 11).

Further, though the present embodiment described the case using the chain 112, a belt member (endless member) made of rubber or the like may be used instead of the chain 112. In this case, a regulating member may be provided on the plane of the belt in contact with the charging rollers 61 so as to prevent relative movement of the charging rollers 61 to the belt in the direction vertical to the axes of the charging rollers 61.

As described, an image forming apparatus incorporating the technology comprises an image carrier for carrying an electrostatic latent image; and a charging roller which rotates in contact with a surface of the image carrier by transmission of a rotation force of the image carrier, wherein: a contact angle of water on a surface of the charging roller is equal to or smaller than a contact angle of water on the surface of the image carrier.

With this arrangement, a contact angle of water on a surface of the charging roller is equal to or smaller than a contact angle of water on the surface of the image carrier. On this account, the grip force between the charging roller and the image carrier increases, and the slip of charging roller is prevented.

The foregoing image forming apparatus may be arranged so that an application voltage to the charging roller on an image forming process is a direct-current voltage.

In a conventional image forming apparatus, in the case where only a direct current is applied to the charging roller, image defect of black stripes due to the slip of charging roller appears particularly significantly. On the other hand, the foregoing structure prevents the slip of charging roller, thereby preventing image defect of black stripes in the case of applying only a direct current to the charging roller.

Further, the movement speed on the surface of the charging roller on an image forming process may be 280 mm/s or greater.

When the movement speed (process speed) on the surface of the image carrier is 280 mm/s or greater, a large contact angle of water on the surface of the charging roller, such as the conventional charging roller, causes slip of the charging roller. On the other hand, the slip of charging roller does not occur in the foregoing arrangement even at a process speed of 280 mm/s or greater.

The foregoing image forming apparatus may further comprise an application section for applying a lubricant agent to at least one of the surfaces of the image carrier and the charging roller.

The application of lubricant agent to at least one of the surfaces of the image carrier and charging roller to prevent ablation of image carrier or adhesion of contaminant (such as toner) to the charging roller however facilitates slip of the charging roller. On the other hand, with the foregoing arrangement, application of lubricant agent to at least one of the surfaces of the image carrier and charging roller does not cause the slip of the charging roller.

Further, the foregoing image forming apparatus may be arranged so that the contact angle of water on the surface of the charging roller is equal to or less than 100°.

With this structure, the setting of contact angle of water on the surface of the charging roller to 100° or less ensures an increase in grip force between the image carrier and the charging roller.

A charging roller incorporating the technology is a charging roller for charging an image carrier by coming in contact with a surface of the image carrier, wherein a surface of the charging roller is processed by corona discharge treatment.

With this structure, the corona discharge treatment processes the charging roller to have a smaller surface contact angle of water. On this account, the grip force between the image carrier and the charging roller increases, which prevents the slip of the charging roller.

The foregoing charging roller may be arranged so that the contact angle of water on the surface of the charging roller is 100° or less. The setting of contact angle of water on the surface of the charging roller to 100° or less ensures an increase in grip force between the image carrier and the charging roller.

A production method of forming a charging roller creates a charging roller for charging an image carrier by coming in contact with a surface of the image carrier. The method comprises the step of: (a) processing a surface of the charging roller by corona discharge treatment.

With this method, the corona discharge treatment processes the charging roller to have a smaller surface contact angle of water. With this effect, the foregoing method makes it possible to produce a charging roller with a greater grip force between the image carrier and the charging roller with which the slip of the charging roller is securely prevented.

In the step (a) in the foregoing method, the corona discharge treatment may be carried out while rotating the charging roller in a periphery direction of the charging roller.

With this method of carrying out the corona discharge treatment while rotating the charging roller in a periphery direction of the charging roller, it is possible to evenly generate corona discharge along the periphery direction of the charging roller. This method therefore provides an even contact angles of water to the entire surfaces of the charging roller.

The step (a) in the foregoing method may be carried out with a production apparatus including a retention section for retaining a plurality of charging rollers; and a plurality of discharge electrodes for generating corona discharge to each of the plurality of charging rollers, so that the plurality of charging rollers are subjected to corona discharge treatment at the same time.

With this method, the corona discharge treatment is carried out to a plurality of charging rollers at the same time (through batch treatment). This increases productive efficiency.

In the step (a) in the foregoing method, a space in which the corona discharge is generated may be shielded from a surrounding space of said space.

With this method, the space in which the corona discharge is generated is shielded from a surrounding space of said space. In this manner, the ozone resulted from the corona discharge is not diffused into the surrounding space.

Further, the foregoing production method of charging roller may be arranged so that, in the step (a), the charging roller being carried passes through a region opposite to a discharge section for generating the corona discharge, so that the charging roller is subjected to corona discharge treatment on its way of carriage.

In this method, the charging roller is carried, and the corona discharge treatment is carried out to the charging roller being carried.

On this account, the corona discharge treatment may be performed to the plural charging rollers sequentially carried (the treatment can be serially carried out). This further increases production efficiency.

The step (a) in the foregoing method may be carried out according to a condition:

$$t > 1.82 \times A$$

where t expresses a time (second) for corona discharge treatment, and A expresses a circumference (mm) of the charging roller.

With this method, it is possible to securely decrease the contact angle of water on the surface of the charging roller.

A production apparatus for forming a charging roller is used to create a charging roller which charges an image carrier by coming in contact with a surface of the image carrier, the production apparatus comprising a retention section for retaining a charging roller; and a discharge section for generating corona discharge to the charging roller retained by the retention section.

With this structure, corona discharge is generated between the charging roller and the discharge section, so as to process the charging roller by a corona discharge treatment. The contact angle of water on the surface of the charging roller thus decreases. This makes it possible to produce a charging roller with a greater grip force between the image carrier and the charging roller with which the slip of the charging roller is securely prevented.

The foregoing production apparatus may further comprise a rotation section for rotating the charging roller retained by the retention section in a periphery direction of the charging roller.

With this structure, the corona discharge treatment can be carried out to the charging roller while rotating the charging roller by the rotation section. In this way, corona discharge is evenly generated along the periphery direction of the charging roller. The contact angle of water on the surface of the charging roller thus becomes even.

The production apparatus of a charging roller may be arranged so that the retention section includes a plurality of roller members whose axes are disposed in parallel to each other, and the charging roller is placed on and in contact with two adjacent ones of said roller members, the rotation section rotates the roller members and thereby rotates the charging roller.

With this structure, by placing the charging roller to be in contact with the adjacent two roller members, it is possible to hold the charging roller while regulating the movement thereof in the direction vertical to the extension direction of the charging roller. Further, the rotation of the roller member allows the charging roller thereon to rotate along the periphery direction. In this way, the charging roller can be rotatably held with a simple structure.

The production apparatus of a charging roller may further comprise a shielding member for shielding a space including a region where the charging roller retained by the retention section and the discharge section are opposed, from a surrounding space of said space.

With this structure, the space in which the corona discharge is generated is shielded from a surrounding space of said space. In this manner, the ozone resulted from the corona discharge is not diffused into the surrounding space.

The production apparatus of a charging roller may be arranged so that the retention section is capable of retaining a plurality of charging rollers, and the discharge section includes a plurality of discharge electrodes for generating corona discharge to each of the charging rollers retained by the retention section. In this case, the discharge section is constituted of either (1) a single casing containing a plurality of discharge electrodes, (2) plural casings each of which has a discharge electrode, or (3) plural corona dischargers.

With this method, the corona discharge treatment is carried out to a plurality of charging rollers at the same time (eg. through batch treatment). This increases productive efficiency.

The production apparatus of a charging roller further comprises a carriage section for carrying the charging roller retained by the retention section so that the charging roller passes through a region opposite to the discharge section.

With this structure, the carriage section carries the charging roller retained by the retention section so that the charging roller passes through a region opposite to the discharge section. Therefore, the corona discharge treatment is carried out to the charging roller being carried. On this account, the corona discharge treatment may be performed to the plural charging rollers sequentially carried (the treatment can be serially carried out). This further increases production efficiency.

The production apparatus of a charging roller may be arranged so that the retention section includes chain-shaped or belt-shaped endless members, which are respectively provided near two extension ends of the charging roller, and two end portions of the charging rollers are placed on the endless members, and the carriage section includes a plurality of supporting members for suspending the endless members, and a rotation drive section for rotating at least one of the supporting members.

With this structure, the rotation drive section rotates the supporting members and thereby rotates the endless member along the suspending form. This also carries the charging roller on the endless member. In this way, the charging roller may be carried with a simple structure.

The production apparatus of a charging roller further comprises a contact member which is provided opposite to the endless members and comes in contact with at least a part of the charging roller in a region opposite to the discharge section and the charging roller, from the opposite side of the endless members, the endless members support the charging roller so that the charging roller is rotatable in a periphery direction, and the endless members each includes a regulation member for regulating the charging roller so that a relative position of the charging roller with respect to the endless members moves to a direction vertical to an extension direction of the charging roller.

Note that, the contact portion between the charging roller with the contact member may be made at a core member (axis) whose two ends are projected from the two ends of the charging roller, or at an elastic layer made of rubber or the like formed on the outer face of the core member.

With this structure, the endless member supports the charging roller while allowing the charging roller along the periphery direction, and a regulating member provided on the plane of the endless member regulates relative movement of the charging roller to the endless member in the direction vertical to the extension direction of the charging roller.

Further, the contact member comes in contact with the upper face of the charging roller in a region where the discharge section and the charging roller are opposed. This gives a frictional force between the regulating member and the upper face of the charging roller into a direction reverse to the carriage direction of the charging roller. Consequently, the corona discharge treatment may be carried out to the charging roller rotated along the periphery direction. In this way, the contact angle of water on the surface of the charging roller becomes even along the periphery direction.

The embodiments and concrete examples of implementation discussed in the foregoing detailed explanation serve solely to illustrate the technical details of the technology, which should not be narrowly interpreted within the limits of such embodiments and concrete examples, but rather may be applied in many variations within the spirit of the technology, provided such variations do not exceed the scope of the patent claims set forth below.

What is claimed is:

1. An image forming apparatus, comprising:

an image carrier for carrying an electrostatic latent image; and a charging roller which rotates in contact with a surface of the image carrier by transmission of a rotation force of the image carrier, wherein a contact angle of water on a surface of the charging roller is equal to or smaller than 0.87 times a contact angle of water on the surface of the image carrier.

2. The image forming apparatus as set forth in claim 1 wherein an application voltage to the charging roller on an image forming process is a direct-current voltage.

3. The image forming apparatus as set forth in claim 1 wherein a movement speed on the surface of the charging roller on an image forming process is 280 mm/s or greater.

4. The image forming apparatus as set forth in claim 1 further comprising an application section for applying a lubricant agent to at least one of the surfaces of the image carrier and the charging roller.

5. The image forming apparatus as set forth in claim 1 wherein the contact angle of water on the surface of the charging roller is equal to or less than 100°.

6. A charging roller for charging an image carrier by coming in contact with a surface of the image carrier, wherein a contact angle of water on a surface of the charging roller is equal to or smaller than 0.87 times a contact angle of water on the surface of the image carrier.

7. The charging roller as set forth in claim 6, wherein a contact angle of water on the surface of the charging roller is 100° or less.

8. A method of producing a charging roller for charging an image carrier by coming in contact with a surface of the image carrier, the method comprising the step of:

(a) processing a surface of the charging roller by corona discharge treatment so that a contact angle of water on a surface of the charging roller is equal to or smaller than 0.87 times a contact angle of water on a surface of the image carrier.

9. The method of producing a charging roller as set forth in claim 8, wherein, in the step (a), the corona discharge treatment is carried out while rotating the charging roller in a periphery direction of the charging roller.

10. The method of producing a charging roller as set forth in claim 9, wherein the step (a) is carried out with a production apparatus including a retention section for retaining a plurality of charging rollers; and a plurality of discharge electrodes for generating corona discharge to each of the plurality of charging rollers, so that the plurality of charging rollers are subjected to corona discharge treatment at the same time.

11. The method of producing a charging roller as set forth in claim 9, wherein, the step (a) is carried out according to a condition:

$$t>1.82\times A$$

where t expresses a time (in seconds) for the corona discharge treatment, and A expresses a circumference (in mm) of the charging roller.

12. The method of producing a charging roller as set forth in claim 8, wherein, in the step (a), a space in which the corona discharge is generated is shielded from a surrounding space.

13. The method of producing a charging roller as set forth in claim 8, wherein, in the step (a), the production apparatus carries the charging roller through a region opposite to the discharge electrodes so that the charging roller is subjected to the corona discharge treatment as it passes by the discharge electrodes.

14. A production apparatus for making a charging roller which charges an image carrier by coming in contact with a surface of the image carrier, the production apparatus comprising:

a retention section for holding a charging roller, the retention section comprising a plurality of roller members having parallel axes for rotating a charging roller, wherein a charging roller is placed on and in contact with an adjacent pair of the roller members; and a discharge section for generating corona discharge to the charging roller retained by the retention section.

15. The production apparatus as set forth in claim 14, further comprising a shielding member for shielding a space including a region where the charging roller is retained by the retention section and the discharge section are opposed, from a surrounding space.

16. The production apparatus as set forth in claim 14, wherein the retention section is capable of retaining a plurality of charging rollers, and the discharge section includes a plurality of discharge electrodes for generating corona discharge.

17. The production apparatus as set forth in claim 14, further comprising a carriage section for carrying the charging roller retained by the retention section so that the charging roller passes through a region opposite to the discharge section.

18. The production apparatus as set forth in claim 17, wherein the retention section includes chain-shaped or belt-shaped endless members that incorporate the plurality of roller members, the endless members being respectively provided near opposite ends of the charging roller, and wherein the opposite ends of the charging roller are placed on adjacent pairs of the rollers on the endless members, and the carriage section includes a plurality of supporting members for suspending the endless members, and a rotation drive section for rotating at least one of the supporting members.

19. The production apparatus as set forth in claim 18, further comprising a contact member which is provided opposite to the endless members and comes in contact with at least a part of the charging roller in a region opposite to the discharge section and the charging roller, from the opposite side of the endless members, wherein the endless members support the charging roller so that the charging roller is rotatable in a periphery direction, and wherein the endless members each includes a regulation member for regulating the charging roller so that a relative position of the charging roller with respect to the endless members moves in a direction perpendicular to an extension direction of the charging roller.

20. A production apparatus for making a charging roller which charges an image carrier by coming in contact with a surface of the image carrier, the production apparatus comprising:

a retention section for retaining a charging roller, wherein the retention section includes chain-shaped or belt-shaped endless members that incorporate a plurality of roller members, the endless members being respectively provided near opposite ends of the charging roller, and wherein the opposite ends of the charging roller are placed on adjacent pairs of the rollers on the endless members;

a discharge section for generating corona discharge to the charging roller retained by the retention section; and a carriage section for carrying the charging roller retained by the retention section so that the charging roller passes through a region opposite to the discharge section, the carriage section including a plurality of supporting members for suspending the endless members, and a rotation drive section for rotating at least one of the supporting members.

* * * * *